United States Patent [19]

Seitzer

[11] 4,213,752

[45] Jul. 22, 1980

[54] COAL DRYING PROCESS

[75] Inventor: Walter H. Seitzer, West Chester, Pa.

[73] Assignee: Suntech, Inc., Philadelphia, Pa.

[21] Appl. No.: 958,308

[22] Filed: Nov. 6, 1978

[51] Int. Cl.[2] ..... F27B 15/00

[52] U.S. Cl. ..... 432/14; 34/10; 44/33; 432/15

[58] Field of Search ..... 432/14, 15; 34/10; 44/33, 1 G

[56] References Cited

U.S. PATENT DOCUMENTS

| | | | |
|---|---|---|---|
| 2,666,269 | 1/1954 | Parry | 34/10 |
| 2,668,099 | 2/1954 | Cederquist | 44/33 |
| 2,704,895 | 3/1955 | Cederquist | 34/12 |
| 2,763,478 | 9/1956 | Parry | 432/15 |
| 2,844,886 | 7/1958 | Nathan | 34/10 |
| 2,871,004 | 1/1959 | Gorin | 432/15 |
| 3,723,079 | 3/1973 | Seitzer | 44/1 G X |
| 3,896,557 | 7/1975 | Seitzer et al. | 34/10 |
| 4,043,763 | 8/1977 | Norman et al. | 44/1 G |

*Primary Examiner*—John J. Camby

*Attorney, Agent, or Firm*—J. Edward Hess; Donald R. Johnson; Paul Lipsitz

[57] ABSTRACT

A single step process for removing moisture from low rank coal using in-situ generated thermal energy by passing the wet low rank coal at room temperature into a moving bed of hot coal at a temperature in the range of from about 200° C. to about 300° C. at a rate to maintain partial combustion of the coal at atmospheric pressure, and in the presence of a gas at atmospheric pressure containing from about 5% to about 20% by volume of oxygen, the heat generated by the combustion being absorbed by the wet coal being fed to the system and being effective for drying the coal to the desired level, and separating the dried coal from the combustion zone, whereby the dry coal obtained is highly resistant to spontaneous combustion.

9 Claims, No Drawings

COAL DRYING PROCESS

Lignitic and subbituminous coals are received from the mine containing from about 25 to 40% internal moisture and such coals are usually subjected to a drying procedure before shipment and use. Numerous types of equipment and techniques for such coal drying are available and have been used for some time. In general, a hot combustion gas is used to drive moisture from the coal and this is done either by passing such gases through a bed of the coal, often a moving or fluidized bed, or by passing the coal through a kiln or other rotary device while the gases are passed through. A particularly useful commercial device for such coal drying is the Parry Dryer (see U.S. Pat. No. 2,666,269) which employs the hot combustion drying gases to fluidize the coal. In commercial use the combustion gases are usually obtained from coal or fuel oil and the fuel-air ratio is maintained so that the combustion gases contain about 5 percent by volume of oxygen.

One of the characteristics of dried coal is its tendency toward spontaneous combustion and this becomes a serious problem during the shipment and storage of such coal. Coal subjected to drying in the presence of oxygen is somewhat improved in its spontaneous combuston character, but improved means for economically drying and stabilizing is desired.

A method for drying lignitic and sub-bituminous coal to impart stabilization against spontaneous combustion is disclosed in U.S. Pat. No. 3,896,557 and involves the heating of the coal in a fluidized bed system with a combustion gas containing 7% to 9% of oxygen by volume to reduce the moisture level of the coal to an amount of from about 8% to about 12%.

Another technique for stabilizing lignitic coal is that disclosed in U.S. Pat. No. 3,723,079 where dried coal is treated with oxygen and then rehydrated with water in the amount of from about 1.5% to about 6% by weight of the oxygen treated coal.

Also of interest is the disclosure of U.S. Pat. No. 2,704,895 (and related U.S. Pat. No. 2,668,099) where peat and similar materials such as straw, wood, lignite, etc. arepartially burned and oxidized in their wet state at elevated temperature by supplying an oxygen containing gas under pressure. The exothermic heat developed in such oxidation provides enough steam to keep the process operable without supplying heat from the external source so that the treated material can then be dewatered by mechanical means (e.g., filtration and/or squeezing) or by thermal means using the steam and vapors generated in the pressure heating (U.S. Pat. No. 2,704,895).

In U.S. Pat. No. 2,844,886 a process for handling wet carbonaceous materials such as coal in a fluid system to effect carbonization is disclosed. In a first step of the disclosed process, surface water is removed from the coal to prevent agglomeration in the fluidizing step. This drying step to remove the surface water involves comingling the comminuted wet coal with dry heated coal in sufficient quantity to elevate the temperature sufficiently to effect removal of the water. The mass of dry coal is then passed through a heater to further elevate the temperature by indirect heat exchange with a hot fluid, using a conventional shell and tube heat exchanger. After the preheating zone the coal is partially burned to "case harden" the particles and it is then carbonized to form a char.

Another disclosure of interest is U.S. Pat. No. 4,043,763 which relates to improving storage stability of lignitic and sub-bituminous coal by the process of mixing said coal dried to a moisture content of from about 0 to about 10% by weight with undried, as-mined coal so that the weight ratio of dried coal to as-mined coal in the stabilized product is from about 1:2 to about 10:1.

A single step process for simultaneously drying and obtaining a very stable product from low rank coal has now been found using in-situ generated thermal energy. In this process the wet coal is conveyed into a moving bed of hot coal at a temperature in the range of from about 200° to about 300° C. at a rate sufficient to maintain partial combustion of the coal at atmospheric pressure and a gas at atmospheric pressure containing from about 5% to about 20% by volume of oxygen is simultaneously passed into the coal burning bed. The heat generated by the combustion is absorbed by the wet coal being fed to the system and is effective for drying of the coal to the desired level. The dried coal is separated from the combustion zone whereby the coal product obtained is also found to be highly resistant to spontaneous combustion and thus the process significantly reduces the fire hazard present in shipping and storing dried coal. A particularly significant feature of the process of the invention is that most of all of the energy for drying the coal is generated in situ and thus a highly efficient, economical process results and gives a very stable, low-moisture product.

The coals used in the process of the invention will be, as indicated, lignitic and sub-bituminous coals and will include North Dakota lignite, Powder River subbituminous coal, Wyodak coal, and the like. Such coals usually contain from about 30 to 40 percent water as they come from the mine.

The coal drying process of the invention can readily be carried out in an apparatus comprising a moving bed such as a fluidized bed of coal to which the wet coal is fed under the conditions described above. For example, a fluidized bed dryer is operated with fluidizing gas made by blending air and recycled off-gas to maintain an oxygen level of about 2% to about 10% and regulating the temperature of the bed at 200°–300° C. by introduction of wet coal. In this manner the product coal has been 5% to 9% oxidized and is extremely stable to spontaneous combustion. After the initial start-up this process can be operated so that little or no external source of heat is required.

If, during the process, the coal becomes less active as its oxidation proceeds, the temperature of the hot coal should be increased somewhat (but still within the range of from about 200° to about 300° C. as given above) in order to maintain the reaction. Alternatively, the oxidation activity may be increased by increasing the oxygen content of the gas phase, but the range of from about 5% to about 20% by volume of oxygen will be maintained. Thus, reaction rate can be controlled either by a temperature increase or an oxygen content increase of the gaseous phase and in this way combustion rate is kept at optimum. It is probable as one feeds in wet coal constantly and withdraws product constantly, that the coal product will contain a small amount of undried coal. The exact amount of undried coal and the temperature of the final product is of course, determined by the particular dynamics of the operation. However, it is an important feature of the invention that very high stability of the coal is obtained even when the product coal is dry. Generally, however, for practical reasons the plant would be operated to permit 0% to 5% moisture levels for the coal product.

It is to be understood that this method of operation allows maximum oxidation of the coal without external cooling and therefor the coal product from the process of the invention is very stable even when dry. This is in contrast to previous methods of stabilizing coal in which much less oxidation occurred and therefore requires the presence of a certain amount of moisture to effect stabilization. This means that when the process of the invention is operated to produce a coal which still contains some moisture, such coal product will have enhanced stability over coals processed by prior art methods which contain the same level of moisture. Since it is often desirable on a cost-benefit basis to process coal by the method of the invention to permit some moisture in the product (up to about 5% as stated above), the product coal, nevertheless, is generally enhanced in stability over coals from prior art drying methods.

Furthermore, the process of the invention has the additional benefit that it is less costly because it uses the in-situ generated thermal energy for drying the added wet coal. This results from the fact that no capital investment is needed. Also, the system of the invention allows greater flexibility in the degree to which coal drying is made to occur because the coal stability is not critically sensitive to a particular moisture level and thus the product coal is very highly stable totally dry or with various moiture levels. Still further there is no need in the process of the invention for a rehydrating step which some prior art processes require to obtain a stabilized coal.

Coals treated as described above were tested for stability by placing the coal in a Dewar flask fitted at the bottom with a sparging tube to pass oxygen through the coal and equipped with a temperature measuring device. The coal (450g.) in the Dewar flask (70 mm I.D.) is about 200 mm. in depth and oxygen saturated with water is passed through it at 62° C. at a rate of 200ml/min. The time for combustion of the coal to occur is noted as shown by the sudden temperature increase and is taken as a measure of stability.

The results of such testing are shown in Table I, the controls being samples dried under vacuum with external heating, but without an oxygen containing gas being used.

TABLE I

| Coal | | Results |
|---|---|---|
| Savage | Control | Combusts in 1.1 hrs. |
| | Method of Invention | Temperature peaked at 114° C. after 5 hours and dropped. (Completely stable) |
| Wyodak | Control | Combusts in 0.7 hrs. |
| | Method of Invention | Temperature peaked at 87° C. after 6½ hrs. and dropped. (Completely stable) |

In order to achieve maximum stability for the processed coal, coal oxidation should be controlled to between about 5% and about 10%, although coal of moderate stability is still obtained outside this range. This is evident from Table II which shows the hours of test time over which Wyoming Sub-bituminous and Montana Lignite is stable versus percent of coal oxidized. As is evident, the optimum stability occurs at the 5% to 10% range, but outside this range stability falls off rapidly.

TABLE II

| | Percent by Weight of Coal Oxidized | Test Time to Combustion (hrs.) |
|---|---|---|
| Wyoming Sub-bituminous | 0 | 0.75 |
| | 1.75 | 1.7 |
| | 1.75 | 3.0 |
| | 3.2 | 2.9 |
| | 6.5 | Completely stable |
| | 14.2 | 2.0 |
| Montana Lignite | 0 | 1.0 |
| | 1.75 | 7.0 |
| | 9.0 | Completely stable |

It will be understood that the degree of oxidation of the coal within the 5% to 10% range indicated above will depend upon the amount of moisture in the starting coal and upon the amount of moisture removed. Table III which follows is illustrative of the degree of oxidation as related to initial and final moisture.

TABLE III

| % Moisture | | |
|---|---|---|
| Initial Coal | Product Coal | % Coal Oxidized |
| 30 | 5 | 5 |
| 30 | 0 | 6 |
| 40 | 0 | 9.3 |
| 40 | 5 | 8.2 |

As can be seen from the above data, the process of the invention gives very low moisture coal with greatly improved stability because of deep oxidation and enables the coal drying process to be carried out efficiently and economically.

The invention claimed is:

1. A single step process for removing moisture from low rank coal using in-situ generated thermal energy by (a) feeding the wet low rank coal at room temperature into a moving bed of hot coal at a temperature in the range of from about 200° C. to about 300° C. at a rate to maintain partial combustion of the coal at atmospheric pressure, (b) maintaining said coal bed in the presence of a gas at atmospheric pressure containing from about 5% to about 20% by volume of oxygen, whereby the in-situ heat generated by the combustion is absorbed by the wet coal being fed to the system and is effective for drying the coal to the desired level, and (c) separating the dried coal from the combustion zone, whereby the dry coal obtained is highly resistant to spontaneous combustion.

2. The process of claim 1 where the coal combustion is carried out in a moving bed.

3. The process of claim 2 wherein the moving bed is a fluidized bed.

4. A single step process for removing moisture from low rank coal using in-situ generated thermal energy by (a) passing the wet low rank coal at room temperature into a moving bed of hot coal at a rate to maintain partial combustion of the coal so that from about 5% to about 10% by weight of said coal is oxidized, (b) maintaining said process at atmospheric pressure and at a temperature in the range of from about 200° C. to about 300° C. by feeding to said coal bed a gas at atmospheric pressure containing from about 5% to about 20% by volume of oxygen, whereby the heat generated by the combustion is absorbed by the wet coal being fed to the system and is effective for drying the coal to the desired level, and (c) separating the dried coal from the combustion zone, whereby the dry coal obtained is highly resistant to spontaneous combustion.

5. The process of claim 4 wherein the coal combustion is carried out in a fluidized bed.

6. The process of claim 5 wherein the coal is a Montana Lignite.

7. The process of claim 5 wherein the coal is a Wyoming subbituminous coal.

8. The process of claim 5 wherein the coal is Wyodak coal.

9. The process of claim 5 wherein the coal is Savage coal.

* * * * *